United States Patent [19]

Romero et al.

[11] 4,167,267

[45] Sep. 11, 1979

[54] PUCK PROJECTING GAME

[76] Inventors: Anibal Romero; George Spector, both of 3615 Woolworth Bldg., 233 Broadway, New York, N.Y. 10007

[21] Appl. No.: 642,684

[22] Filed: Dec. 22, 1975

[51] Int. Cl.[2] ..... A63B 67/12

[52] U.S. Cl. ..... 273/95 E; 273/106 B

[58] Field of Search ..... 273/95 R, 95 E, 95 F, 273/102 R, 105 R, 105 A, 127 R, DIG. 26, 58 F, 58 H, 231, 106 B, 128 R, 128 A

[56] References Cited

U.S. PATENT DOCUMENTS

| | | | |
|---|---|---|---|
| 441,099 | 11/1890 | Hoyt | 273/95 E |
| 996,458 | 6/1911 | Coleman | 273/128 A X |
| 1,663,404 | 3/1928 | Hands | 273/95 E |
| 2,183,107 | 12/1939 | Savage | 273/95 E |
| 2,261,448 | 11/1941 | Petersen | 273/95 E |
| 2,264,492 | 12/1941 | Weaver | 273/DIG. 26 |
| 2,343,506 | 3/1944 | Hay | 273/95 E |
| 2,611,615 | 9/1952 | Watson | 273/95 E |
| 3,697,072 | 10/1972 | Park | 273/95 E |

FOREIGN PATENT DOCUMENTS

| | | | |
|---|---|---|---|
| 618405 | 4/1961 | Canada | 273/85 B |
| 10859 | 5/1905 | United Kingdom | 273/231 |

*Primary Examiner*—Anton O. Oechsle

[57] ABSTRACT

A game played competitively between two players, consisting of a gameboard upon which each player attempts to flip his own puck from various puck kick off positions towards a center cup inside his own score frame; the gameboard also including a numbered score keeper with a slidable indicator along each long side edge of the gameboard for each of the players in order to determine a winner.

1 Claim, 4 Drawing Figures

HOME TEAM
VISITOR TEAM
HOME

PUCK PROJECTING GAME

This invention relates generally to competitive games of the type that employ gameboards.

A principal object of the present invention is to provide a game in which a player tries to flip his own puck by means of a flipping tool so that the puck is flipped upward from a top surface of the gameboard and into a score frame having a center cup in order to attain a score.

Another object is to provide a puck game which accordingly challenges the skill of a player in aiming a puck toward a goal via a flipping action.

Still another object is to provide a puck game which is suitable either for children or adults and which is entertaining as well as being skillful.

Other objects are to provide a puck game which is simple in design, inexpensive to manufacture, rugged in construction, easy to use and efficient in operation.

These and other objects will be readily evident upon a study of the following specification and the accompanying drawing wherein.

Figures 1, 2, 2A, 3, 4:
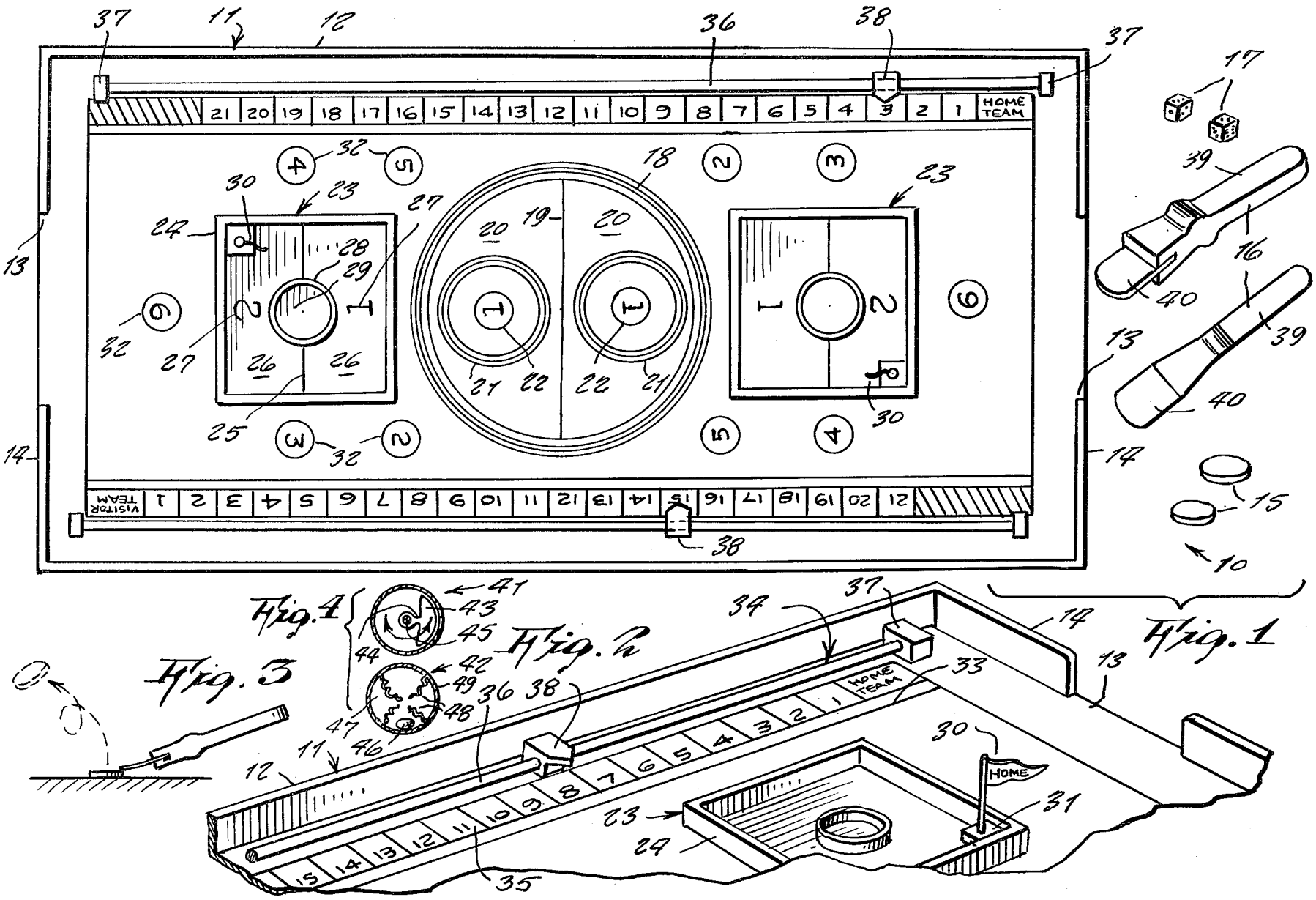
FIG. 1 is a top view of the game board and also showing other equipment that is used in playing the game.
FIG. 2 is a fragmentary perspective view of the gameboard.
FIG. 3 is a detail side view showing how a puck playing piece is flipped by a puck shooter.
FIG. 4 is a modified design of two pucks shown in a cross sectional view.

Referring now to the drawings in detail, and more particularly to FIGS. 1 to 3 at this time, the reference numeral 10 represents a puck game according to the present invention wherein there is a gameboard 11 of rectangular shape having an upstanding wall 12 all around except for an opening 13 therethrough along a center of each end edge 14, and the gameboard having a playing piece 14 upon its upper side upon which a pair of pucks 15 are each moved by a puck shooter 16. The game also includings a pair of dice 17 for starting the game, a dice cup (not shown) and an instructions booklet, not shown, for rules in playing the game.

The playing field consists of a printed central circular ring 18 divided by a central line 19 into two spaces 20 each of which contains its own circular ring 21 and concentric kick off portion 22 identified with a numeral no. 1. Between the central ring 18 and each end of the playing field there is a score frame 23, one of which is used by each player as a goal. Each score frame includes a raised square wall 24 around a central space divided by printed line 25 into two areas 26 each of which is imprinted with a different scoring numeral 1 and 2 as shown at 27. Within a center of the space enclosed by wall 24 there is a raised circular wall 28 around a center opening that defines a center cup 29. A flag 30 supported in a block 31 affixed at a corner of the frame is imprinted with the word "Home".

A set of five other puck kick-off positions 32 are located all around each score frame and are numbered from 2 to 6.

Along each longitudinal side edge of the playing field there is a score keeper 34 consisting of a printed scale 35 number from 1 to 21; one score keeper being identified for a "Home team" and the other being identified for a "Visitor team." A rod 36 supported at each end in blocks 37 carries a slidable arrow indicator 38 for pointing selectively to the numbers on the scale 35.

Each puck 15 consists of a flat circular disc. Each shooter 16 includes a handle 39 and resilient tongue 40 so to snap off the edge of the puck in order that it flips such as a tiddledy-wink disc, and as is indicated in FIG. 3, so that the puck can land inside the score frame or central cup.

In playing the puck game, entitled "Tough Puck" reference is now made to the following instructions.

RULES TO PLAY TOUGH PUCK:

1. To start game, throw the dice from the cup, the player who scores the higher number will be the visitor.
2. The game is over when one of the player scores 21 or more points.
3. There are six (6) different positions to kick the puck from into the score frame, each position has a different value; as explained hereinbelow:
4. A puck landing in space 1 scores one point. A puck landing in space 2 scores two points. A puck landing in center cup 29 scores four points A. Position #1: one chance, but if the player scores 4 points in the center cup, he is intitled to play again (3 extra shots for that position).

B. From positions 2 and 5, the player has two (2) chances, but if he does score 5 points from that position, he is able to play again one more time.

C. From position 3–4, the player has 3 chances, but if he scores in 6 points from that position he will play again once more.

D. From position #6, all plays will be scored double and players have no extra play.

THE FOLLOWING ARE THE REGULATIONS OF THE GAME:

A. If a puck falls out of the game field, the player loses all other chances in that round.

B. Throw the dice (numbered) from the cup to select position; and use the nail shooter as directed in the drawing.

C. If the puck hits the score frame of the opponent player and returns back to the player zone, it is a fault, and the player who shot the puck losses all other chances and an automatic 1 point if he has any score.

D. If the player shoots the puck and it accidently lands on top of any number in the shooting zone of the opponent, this means that the player has a chance to shoot from that zone into his opponent's score frame, but loses all other chances if there are any in that round.

OTHER RULES OF THE GAME INCLUDE THE FOLLOWING:

A. Call "Knock Off Play:" This play is only allowed when one of the players had already scored 15 points or more, and the other one has less than 10 points. The player calling the "knock-off play" does not score himself but instead may reduce his opponents score in accordance with his shots.

B. Knock Off Play: A player has two chances from position 2, if the player shoots the puck into the center cup, his opponent loses 4 points; and if the player scores twice in the center cup, the opponent loses 10 points.

C. After a player had already shot the knock-off play, his opponent takes over.

D. This play is only allowed one per player.

In FIG. 4 a modified design of two pucks 41 and 42 are shown in cross section. Puck 41 comprises a hollow flat shell inside of which a weight 43 on an end of arm 44 pivotable about fixed central pin 45 swings in an unpredicable direction due to being hidden inside, and when it is flipped so that as it flips upward into the air it additionally may or may not additionally fly on a sidewardly course rather than straight ahead, thus making the game more challenging.

The puck 42 is also a hollow shell inside of which a drop of mercury 46 may or may not roll from one chamber 47 to another and which are formed by corrugated partitions 48 extending radially a short distance from peripheral wall 49 so that the mercury force may strike certain of the walls thus thrusting the puck partly into the direction of the mercury force against such walls, and which being hidden, is unpredictable.

Thus modified designs of pucks are provided.

While various changes may be made in the detail construction, it is understood that such changes will be within the spirit and scope of the present invention as is defined by the appended claims. What is claimed is:

1. In a puck projecting game the combination of a game board, a plurality of pucks for movement upon said game board, a plurality of shooters for flipping said pucks upon said game board, a pair of conventional dice for determining a start of said game between players, wherein said game board includes a pair of spaced parallel scorekeepers along opposite longitudinal edges of said game board, a center of said game board between said scorekeepers comprising of a playing field upon said center of which there is printed a large kickoff circle containing a pair of spaced symmetrical smaller circles, and a pair of score frames being mounted upon said playing field, said score frames being symmetrically positioned adjacent opposite sides of said printed large circle, each said score frame including a raised, square shaped wall around a central area containing a central circular walled central cup defending a goal area, wherein each said scorekeeper includes a printed row of numbers, and an indicator arrow slidable along a bar supported at opposite ends upon blocks mounted on said game board, said indicator arrow pointing to said row of numbers, wherein said score frames centers are axially aligned with the center of said kick-off circle wherein a plurality of kickoff positions additional to said kick-off circle are imprinted on said playing field around each said score frame, each said kick-off position being printed with a different number, wherein each said puck comprises a circular disc, and each said shooter includes a thin resilient blade projecting centrally from one end of a thicker stiff handle, wherein the puck includes movable means for causing erractic flight pattern whereby said means changes the center of gravity of said puck haphazardly during flight and the said means is a member pivoted about the puck center.

* * * * *